US005098307A

United States Patent [19]

Francisco

[11] Patent Number: 5,098,307

[45] Date of Patent: Mar. 24, 1992

[54] ADJUSTABLE DUPLEX RECEPTACLE

[76] Inventor: Thomas E. Francisco, 2676 Eggert Rd., Tonawanda, N.Y. 14150

[21] Appl. No.: 667,463

[22] Filed: Mar. 11, 1991

[51] Int. Cl.[5] ..... H01R 29/00

[52] U.S. Cl. ..... 439/189; 439/188; 200/51.02; 200/51.03; 200/51.09

[58] Field of Search ..... 439/189, 188; 200/51.02-51.06, 51.09, 51.10, 566, 284

[56] References Cited

U.S. PATENT DOCUMENTS 1,669,784 5/1928 Scofield ..... 200/51.03

3,246,179 4/1966 Berner ..... 200/51.02

3,596,019 7/1971 Koester ..... 200/51.09

3,852,703 12/1974 Carney et al. ..... 439/188

*Primary Examiner*—Paula A. Bradley

*Attorney, Agent, or Firm*—Howard J. Greenwald

[57] ABSTRACT

An adjustable duplex receptacle which contains four bus bars is disclosed. One of the bus bars is attached to a spring-loaded leg which, with the use of an adjustable, rotatable pin, can be caused to contact either of two of the other bus bars. The pin may be locked into one position by means of a locking mechanism.

17 Claims, 4 Drawing Sheets

ADJUSTABLE DUPLEX RECEPTACLE

FIELD OF THE INVENTION

An electrical receptacle which, by the use of a manual switch, can be converted from one mode of operation to another.

BACKGROUND OF THE INVENTION

The prior art has recognized that, in many electrical installations, it is sometimes desirable that a given electrical outlet (or a group of outlets) be connected to an electrical power supply through a switch located away from the outlet(s). The art also recognizes that, at other times, it is desirable for the outlet(s) to be directly connected to electrical power without being subjected to control by a remote switch.

In U.S. Pat. No. 3,246,179 of Ray Berner, there is described an electrical outlet device which may be selectively connected directly to electrical power or, alternatively, may be connected to electrical power through a separate switch externally located with respect to the outlet.

The Berner patent discloses a receptacle providing electrical connections for two plugs, which is also often referred to as a "duplex receptacle." In his receptacle, both plugs will simultaneously either be connected directly to electrical power or, alternatively, to a separate switch. It is not possible, with the device of Berner, to connect one of the plugs directly to the electrical power and the other one to the external switch.

In modern electrical installations, it is often very desirable to be able to connect one of the plugs of a duplex receptacle a constant power source and to connect the other plug to an external switch. Thus, the former plug may be used to power an appliance requiring constant power, such as a clock. The latter plug may be used to power a light, for example, which may be turned off and on with the external switch.

It is an object of this invention to provide an adjustable duplex receptacle comprised of two plugs which is so configured that both of the plugs may be connected to a constant power source or, alternatively, one of the plugs may be connected through an external switch to a constant power source.

It is another object of this invention to provide a simple, inexpensive adjustable duplex receptacle which can readily be changed by manual means so that the electrical connections of at least one of its plugs can be varied.

SUMMARY OF THE INVENTION

In accordance with this invention, there is provided an adjustable duplex receptacle which is comprised of at least a first bus bar, a second bus bar, a third bus bar, and a fourth bus bar. The third bus bar is attached to a spring loaded leg which, with the use of an adjustable, rotatable, nonconductive pin, may be caused to contact either the first bus bar or the second bus bar. The pin may preferably be locked into one position by means of a locking mechanism comprised of a cam and a latch.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
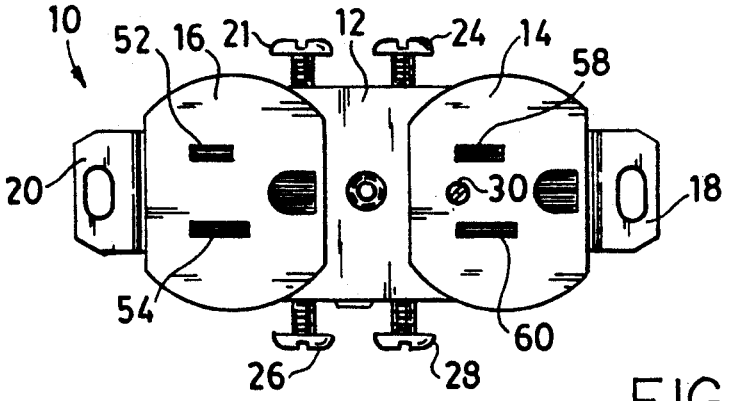
FIG. 1 is a top view of the a preferred embodiment of the duplex receptacle of this invention.

Referring to FIG. 1, the duplex outlet 10 of this invention is comprised of a body (or housing) 12 suitably recessed to receive to plug in female receptacles 14 and 16, respectively. Each of the receptacles 14 and 16 is preferably provided with a grounding plate 18 and 20, respectively. Electrical connections may be made to duplex receptacle 10 by means of connecting terminal screws 22, 24, 26, and 28. In the embodiment shown in FIG. 1, terminal screws 22, 24, 26, and 28 are not spring loaded. In another embodiment, not shown, these terminal screws are spring loaded.

Extending upwardly from the cavity of the receptacle 10 to the surface of body 12 of the duplex outlet 10 is an adjustment pin 30, which preferably is at least partially nonconductive. As will be described in more detail below, this pin 30 also extends downwardly into the inner cavity (not shown in FIG. 1) of receptacle 10 and allows one to manually change the connections made within receptacle 10.

Figure 2:
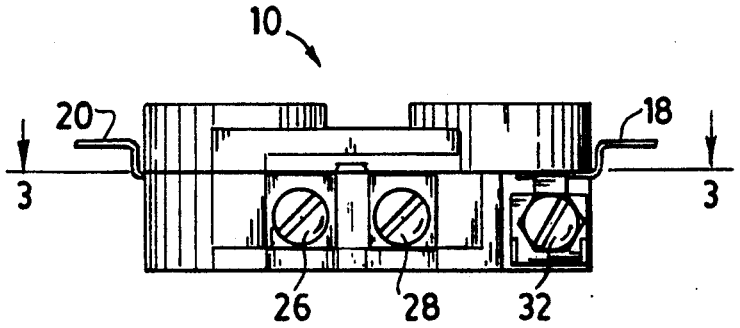
FIG. 2 is a side view of the embodiment of FIG. 1.

FIG. 2 is a side view of the receptacle depicted in FIG. 1. Referring to FIG. 2, it will be seen that this preferred receptacle is comprised of a grounding screw 32 which is electrically connected to (and is part of) grounding plate 18. Although not shown in FIG. 2, it is preferred that grounding plates 18 and 20 be an integral body. Thus, the connection of grounding screw 32 to plate 18 also acts to ground plate 20.

Figure 3:
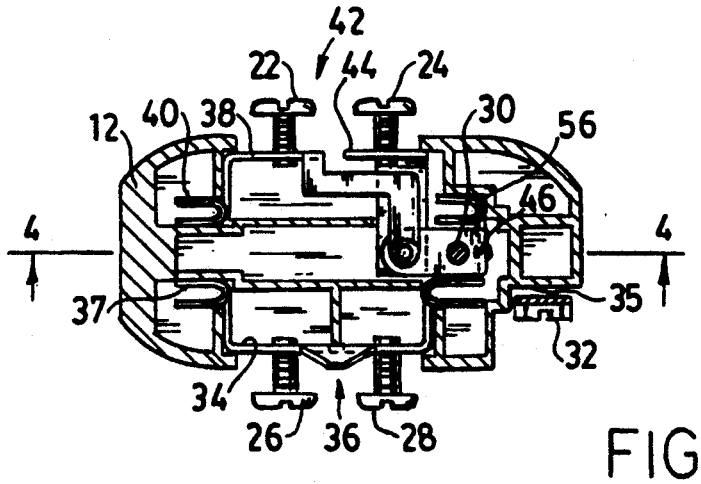
FIG. 3 is an exposed, top view of the embodiment of FIG. 1, showing the components of the duplex receptacle of said Figure.

Referring to FIG. 3, it will be seen that the preferred duplex receptacle 10 is comprised of a multiplicity of separate bus conductors, at least three of which are connected to one or more separate terminal screws.

Terminal screws 26 and 28 are connected to bus conductor 34, which in turn is connected to terminals 35 and 37. Because these connecting terminal screws 26 and 28 are directly connected by bus conductor 34, and because the bus conductor 34 is, in turn, directly connected to the negative side of the electrical power supply, then the left side 36 of receptacle 10 is the neutral side.

Bus conductors are well known to those skilled in the electrical art and are described, e.g., in the Leviton Wiring Device Catalog D-300 (Leviton Manufacturing Company, Inc., Little Neck, N.Y. 11362, 1990), the disclosure of which is hereby incorporated by reference into this specification. As used in this specification, the term "bus conductor" refers to an integral, conductive member which is electrically connected to either a terminal and/or another bus conductor.

Referring again to FIG. 3, it will be seen that terminal screw 22 is electrically connected to bus conductor 38 which, in turn, is connected to terminal 40. Because bus conductor 38 is directly connected to the positive side of the electrical power supply, then the section 42 of receptacle 10 is the "constant hot" section of the positive side.

Referring again to FIG. 3, terminal screw 24 is connected to bus conductor 44. As will be discussed later in this specification, bus conductor 44 is preferably not connected to any terminal, but it may be connected to an external switch or a secondary power source.

It will also be seen from FIG. 3 that the outlet 10 also comprises conductor bus 46.

Figure 4:
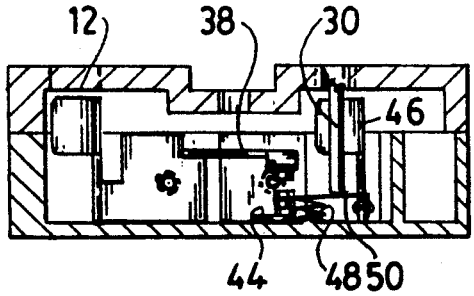
FIG. 4 is an exposed, side view of the embodiment of FIG. 1.

FIG. 4 is a cutaway side view of the embodiment of FIG. 1. Referring to FIG. 4, it will seen that, when pin 30 is depressed against spring 48, plate 50 makes contact with bus conductor 44. When, however, the pressure on pin 30 is released, spring 48 urges the pin upwardly so that plate 50 makes contact with conductor bus 38.

Figure 5:
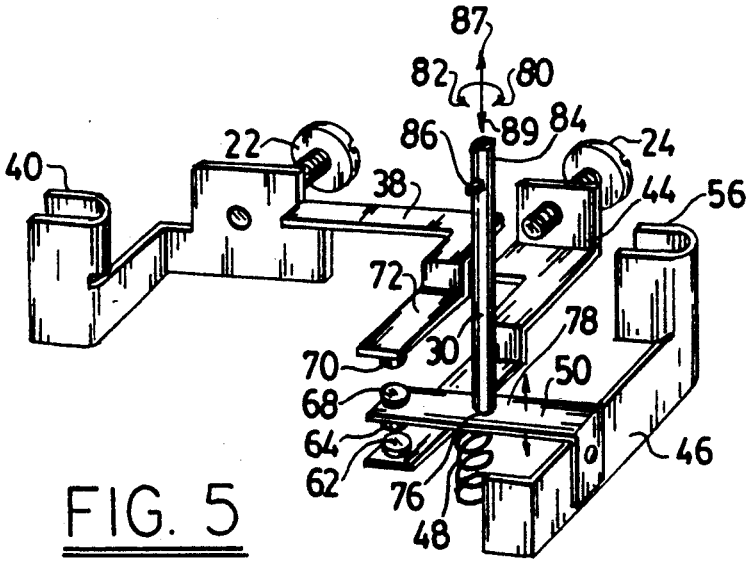
FIG. 5 is a perspective view of the bus bars and the pin used in the embodiment of FIG. 1.

FIG. 5 illustrates the operation of the receptacle 10 of this invention. Terminal 40 is accessible through orifice 52 of receptacle 10(see FIG. 1). Orifice 54 of receptacle 10 communicates with the neutral terminal 37 of conductor bus 34 (see FIG. 3). Terminal 56 of conductor bus 46 (see FIG. 5) is accessible through orifice 58 of receptacle 10 (see FIG. 1). Orifice 60 of receptacle 10 communicates with the neutral terminal 35 of conductor bus 34.

Referring again to FIG. 5, it will be seen that, when pin 30 is pushed down, spring-loaded plate contact 50 makes contact with contact 62 of conductor bus 44. When such contact is made, current flows from the positive side of the power supply (not shown) through terminal screw 24, through conductor bar 44, through contact 62, through plate contact 64 of plate 50, through conductor bus 46, and to terminal 56. In this case, terminal 35 is connected to neutral, and terminal 56 through terminal screw 24 to either an external switch (not shown) or a secondary power source (not shown). In this case, thus, the external switch may be used to turn power to the right plug off and on. Alternatively, a secondary power supply may be used to supply power to the circuit.

When, on the other hand, pin 30 is allowed to be pushed upwardly by the action of spring 48, contact is made between contact 68 of plate 50 of conductor bus 46, and contact 70 of plate 72 of conductor bus 38. In this case, terminal 35 is still connected to neutral, and terminal 56 is electrically connected to terminal screw 22. In this case, the terminal 56 is directly connected to the direct hot power supply.

Thus, it will be seen that, when pin 30 is not pressed down, both the right plug 14 and the left plug 16 are directly connected to the direct hot power supply. However, when rod 30 is depressed, although the left plug 16 remains directly connected to the direct hot power supply, the right plug 14 now is connected to either the external switch or the secondary power source.

The receptacle 10 of this invention is provided with an integral, unitary means for manually locking the right plug 14 into a position where it is either directly connected to the direct hot power supply or, alternatively, connected to the external switch and/or the secondary power source. This locking means is comprised of rotatable, nonconductive pin 30.

Pin 30 is preferably contiguous with and rotatably mounted on plate 50 (see FIG. 5). In the preferred embodiment, the bottom surface 76 of pin 30 is contiguous with the top surface 78 of plate 50, and the pin is free to rotate in the directions of arrows 80 or 82. Any means of rotatably mounting pin 30 on plate 50 may be used. Thus, e.g., pin 30 may be allowed to sit on plate 30. Thus, e.g., a hole (not shown) may be provided in plate 50 through which a projection extending downwardly from surface 76 of pin 30 may extend. Other conventional means of rotatably mounting pin 30 on plate 50 may be used.

Pin 30 is preferably nonconductive. At least the portion 76 which contacts plate 50 does not conduct electricity. At least such portion (and preferably the entire pin 30) consists essentially of a nonconductor such as, e.g., fiberglass.

Integrally formed on the upper portion 84 of pin 30 is a horizontally-extending latch 86.

In the preferred embodiment illustrated in the figures, the body 12 of receptacle 10 is comprised of an orifice 88 through which pin 30 extends. The inner surface 90 of body 12 is also provided with a cammed surface 92 which latch 86 of pin 30 follows. When pin 30 is turned in the direction of arrow 82 (see FIG. 5), the latch 86 is allowed to ride to its up position 94, pin 30 thus rises, and contact is made between plates 50 and 72. When pin 30 is turned in the direction of arrow 80 (see FIG. 5), the latch is caused to move to its down position 96, pin 30 is depressed, and contact is made between plate 50 and conductive bus 44. A blade (not shown) may be inserted in groove 98 to turn pin 30.

Latch 86 of rod 30 provides a means for locking pin 30 in its down position. Once the rod 30 is locked in the down position, no reasonable amount of force in the directions of arrows 87 and/or 89 will cause it to move to its up position; only the movement of rod 30 in the direction of arrow 82 will unlock the rod.

The locking feature of applicant's outlet prevents it from accidentally changing its connections because of accidental contact, the careless pulling of a plug, or wear.

Figure 6:
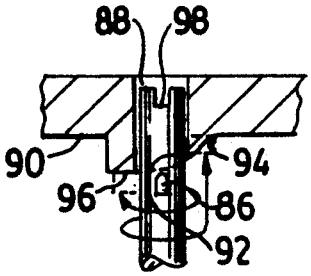
FIGS. 6 and 7 illustrate one preferred locking mechanism for the pin depicted in FIG. 5.

In the preferred embodiment illustrated in FIG. 6, pin 30 is provided with a screw slot which will facilitate rotation of pin 30 is either a clockwise or counterclockwise direction.

Figure 7:
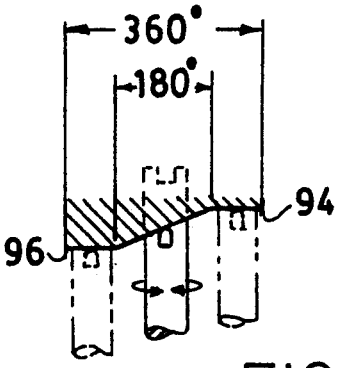

FIG. 7 also illustrates how the rotation of pin 30 can move the cam from one position to another.

Figure 8:
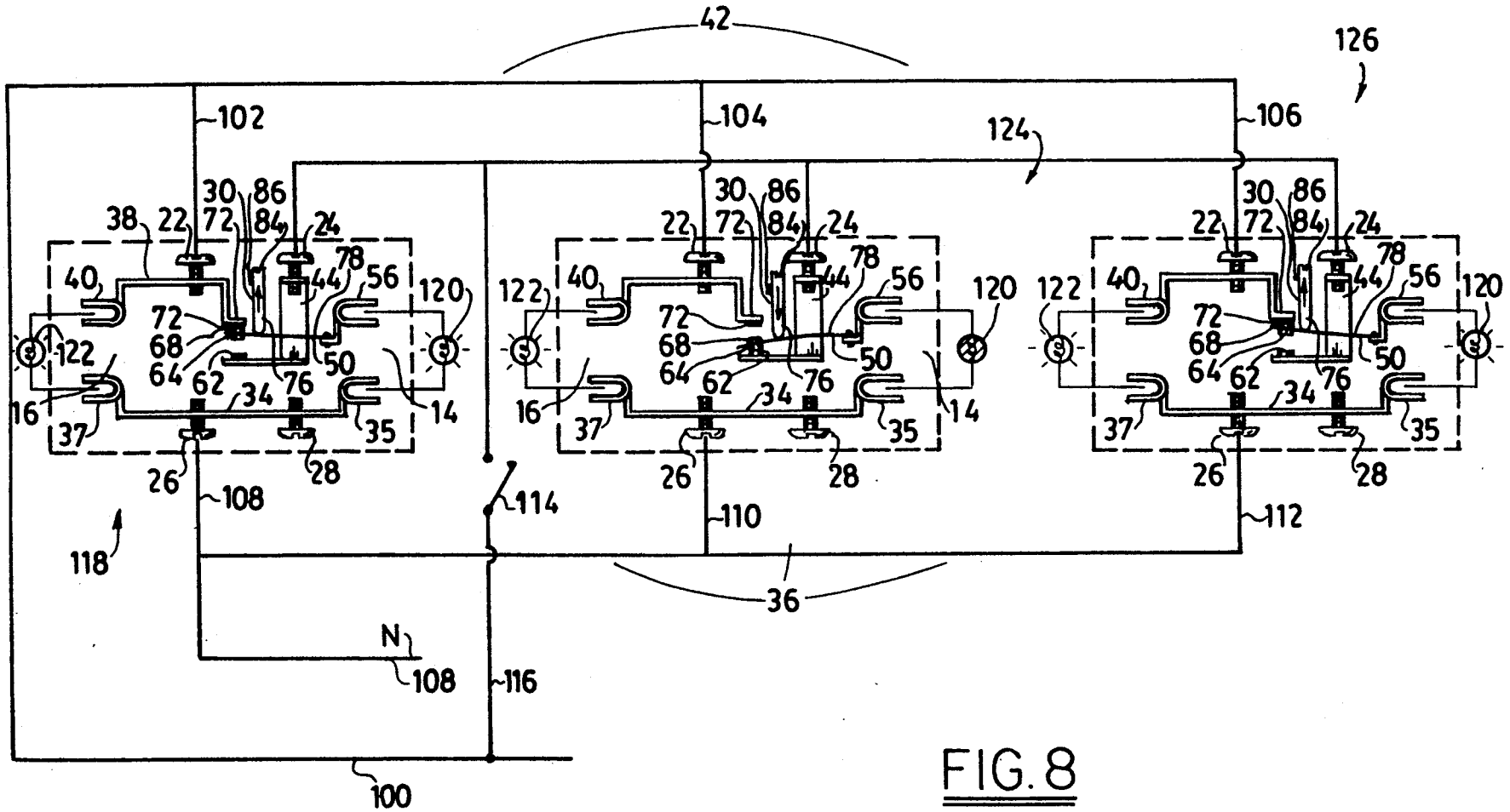
FIGS. 8 and 9 are wiring diagrams illustrating the use of the embodiment of FIG. 1 in changing the connections of its duplex plugs.
Figure 9:
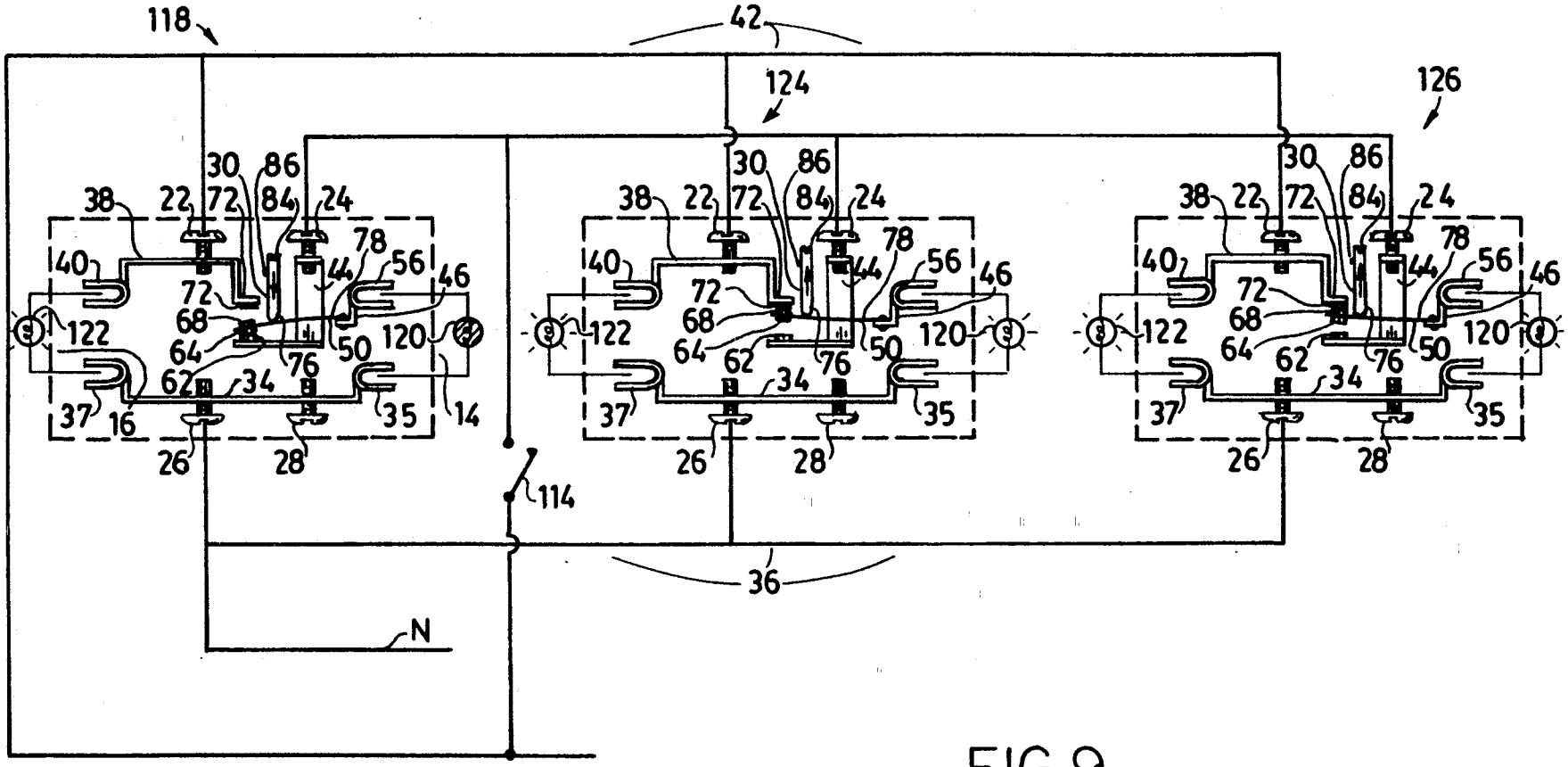

FIGS. 8 and 9 are wiring diagrams illustrating the flexibility which applicant's claimed receptacle 10 allows one. In each of these wiring diagrams, the neutral side of the circuit is side 36, and the positive side of the circuit is side 42.

Referring to FIG. 8, it will be seen that the circuit 100 provides direct, positive, constant hot power to each of terminal screws 22 via line 102, 104, and 106, respectively. The negative end of the circuit is connected to terminal screws 26 via lines 108, 110, and 112, respectively. Positive, constant hot power is also provided to switch via line 116.

In receptacles 118 and 126, where rod 30 is in its up position, both receptacles 14 and 16 are directly connected to the positive, constant hot line and, thus, cause lamps 120 and 122 to light, even when switch 114 is open.

In receptacle 124, when rod 30 is in its down position, receptacle 16 is still directly connected to the positive, constant hot line and, thus, will cause lamp 122 to light.

However, receptacle 14 is now connected to the constant hot line via switch 114 which, because it is open, cuts the flow of power to lamp 120.

FIG. 9 shows a circuit similar to that of FIG. 8, with the exception that rod 30 is in a different position for each of receptacles 118 and 124 than it is in FIG. 8.

Thus, in FIG. 9, the rod 30 is in the down position in receptacle 118, causing plug 14 to be connected through switch 114 to the constant how power line. Because switch 114 is open, lamp 120 is not lit.

Thus, in FIG. 9, the rod 30 is in the up position in receptacles 124. This receptacle is now connected in the manner of receptacle 118 of FIG. 8, and thus both lamps 120 and 122 are lit.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An adjustable duplex receptacle comprised of:

(a) a body comprised of a first female receptacle and a second female receptacle, (b) a first integral electrical contact, a second integral electrical contact, a third integral electrical contact, and a fourth integral electrical contact, wherein:

said first, integral electrical contact is comprised of a first terminal and a second terminal and a first terminal screw, said second integral contact is comprised of a third terminal, a second terminal screw, and a first contact plate, said third, integral contact is comprised of a third terminal screw and a second contact plate, said fourth, integral contact is comprised of a fourth terminal and a third movable contact plate, said third movable contact plate is disposed between said first contact plate and said second contact plate and is contiguous with one of said first contact plate and said second contact plate, (c) resilient means tending to urge said third contact plate towards said first contact plate;

(d) a movable rod in contact with said third contact plate;

(e) means for locking said rod when said third contact plate is contiguous with said second contact plate;

(f) means for unlocking said rod and allowing said resilient means to force said third contact plate in contact with said first contact plate;

(g) means for directly connecting an electrical power supply to said first integral electrical contact, and (h) means for directly connecting an electrical power supply to said second integral electrical contact.

2. The duplex receptacle as recited in claim 1, wherein said movable rod is nonconductive.

3. The duplex receptacle as recited in claim 1, wherein said resilient means is comprised of a spring in contact with said third contact plate.

4. The duplex receptacle as recited in claim 1, wherein said movable rod is rotatably mounted on said third contact plate.

5. The duplex receptacle as recited in claim 1, wherein said movable rod is comprised of a latch.

6. The duplex receptacle as recited in claim 1, wherein said movable rod is comprised of a screw slot.

7. The duplex receptacle as recited in claim 1, wherein said body is comprised of an inner, cammed surface.

8. The duplex receptacle as recited in claim 1, wherein said receptacle is comprised of means for forcing said movable pin in a downward direction when said pin is rotated in a counter-clockwise direction.

9. The duplex receptacle as recited in claim 1, wherein said receptacle is comprised of means for forcing said movable pin in an upwards direction when said pin is rotated in a clockwise direction.

10. The duplex receptacle as recited in claim 1, wherein each of said first female receptacle and said second female receptacle is electrically connected to said first electrical contact.

11. The duplex receptacle as recited in claim 10, wherein said movable rod is nonconductive.

12. The duplex receptacle as recited in claim 11, wherein said resilient means is comprised of a spring in contact with said third contact plate.

13. The duplex receptacle as recited in claim 12, wherein said movable rod is rotatably mounted on said third contact plate;

14. The duplex receptacle as recited in claim 13, wherein said movable rod is comprised of a latch.

15. The duplex receptacle as recited in claim 14, wherein said movable rod is comprised of a screw slot.

16. The duplex receptacle as recited in claim 15, wherein said body is comprised of an inner, cammed surface.

17. The duplex receptacle as recited in claim 16, wherein said receptacle is comprised of means for forcing said movable pin in a downward direction when said pin is rotated in a counter-clockwise direction.

* * * * *